US011717836B2

(12) United States Patent
Osoy Gonzalez

(10) Patent No.: US 11,717,836 B2
(45) Date of Patent: Aug. 8, 2023

(54) COLD WATER COLLECTOR SAPONIFICATION METHOD

(71) Applicant: William Giovanni Osoy Gonzalez, Montreal (CA)

(72) Inventor: William Giovanni Osoy Gonzalez, Montreal (CA)

( * ) Notice: Subject to any disclaimer, the term of this patent is extended or adjusted under 35 U.S.C. 154(b) by 289 days.

(21) Appl. No.: 16/898,051

(22) Filed: Jun. 10, 2020

(65) Prior Publication Data

US 2021/0008571 A1 Jan. 14, 2021

Related U.S. Application Data

(60) Provisional application No. 62/921,833, filed on Jul. 10, 2019.

(51) Int. Cl.

| | |
|---|---|
| ***B03D 1/00*** | (2006.01) |
| ***B03D 1/016*** | (2006.01) |
| ***B01F 23/43*** | (2022.01) |
| ***B01F 23/40*** | (2022.01) |
| ***B01F 25/10*** | (2022.01) |
| ***B01F 27/272*** | (2022.01) |
| *B01F 101/49* | (2022.01) |

(52) U.S. Cl.

CPC ..... *B03D 1/016* (2013.01); *B01F 23/405* (2022.01); *B01F 23/43* (2022.01); *B01F 25/10* (2022.01); *B01F 27/272* (2022.01); *B01F 2101/49* (2022.01); *B01F 2215/0472* (2013.01); *B01F 2215/0477* (2013.01); *B01F 2215/0481* (2013.01); *B03D 2201/02* (2013.01)

(58) Field of Classification Search

CPC .... B01F 23/405; B01F 23/43; B01F 2101/49; B01F 2215/0472; B01F 2215/0481; B01F 2215/0477; B03D 2201/02; B03D 1/016; C11D 13/00; C11D 13/10

See application file for complete search history.

(56) References Cited

U.S. PATENT DOCUMENTS

| | | | | |
|---|---|---|---|---|
| 2,547,280 A * | 4/1951 | Peterson | ..... | C11D 13/02 510/458 |
| 4,397,760 A * | 8/1983 | Story | ..... | C11D 13/10 510/147 |
| 2013/0266703 A1* | 10/2013 | Hassan | ..... | C11B 1/02 366/144 |

* cited by examiner

*Primary Examiner* — Anshu Bhatia

(74) *Attorney, Agent, or Firm* — Brouillette Legal Inc.; Robert Brouillette

(57) ABSTRACT

A cold water saponification method is disclosed. The method is for preferred use in industrial applications such as mining operations wherein saponification of fatty acids is required. Broadly, the method comprises the steps of filling a tank with a solution comprising water, a base and fatty acids, installing a mixer capable of creating a vortex in order to effectively saponify fatty acid particles. The use of a high-shear mixer installed vertically has been proven successful in saponifying fatty acids in cold water.

14 Claims, 2 Drawing Sheets

COLD WATER COLLECTOR SAPONIFICATION METHOD

CROSS-REFERENCE TO RELATED APPLICATIONS

The present patent application claims the benefits of priority of commonly assigned American Provisional Patent Application No. 62/921,833, entitled "COLD WATER COLLECTOR SAPONIFICATION METHOD" and filed at the American Patent Office on Jul. 10, 2019.

FIELD OF THE INVENTION

The present invention generally relates to saponification methods in the mining field.

BACKGROUND OF THE INVENTION

In mining operations, mineral pulp is often employed to extract desired minerals through a process called flotation. One way to do so involves the use of fatty acids as flotation collectors. For such uses, there are several kinds of fatty acids with varying properties which can be derived from beef tallow, tall oil, and vegetable sources, to name a few. Yet, a recurring problem from the use of fatty acids in applications of the sort is that sometimes they are not as efficient at collecting minerals when used in cold water. This is often the case when the pulp water temperature is below the fatty acid's pour point. That is why several mines turn them into water-soluble soaps by using a chemical reaction with caustic soda in water, or other similar base, by a process called "saponification".

Once fatty acids are saponified, they disperse more easily in the cold mineral pulp, which allows them to perform their function more efficiently. Unfortunately, it is difficult to saponify fatty acids when water used to make this reaction is at a lower temperature than the fatty acid's pour point and often close to freezing point. When fatty acids are in cold water, agglomerations of multiple fatty acid particles may form, thus reducing saponification effectiveness and consequently becoming operationally prohibitive.

One known method to solve this issue is the heating of the saponification basin's water to allow an efficient initial dispersion of fatty acid particles. Heating cold water, with temperatures often starting near freezing point, to temperatures exceeding fatty acid's pour point, which often is above 15° C., is an expensive process, especially considering the enormous quantity of water to heat in industrial applications. Indeed, the fatty acids generally only comprise 2 to 3% of the final formulation, the rest being water.

It is thus economically necessary to have a method of saponification that is efficient in cold water.

SUMMARY OF THE INVENTION

The aforesaid and other objectives of the present invention are realized by generally providing a cold water saponification method which uses existing equipment to realize the saponification of fatty acids in cold water.

In a first aspect of the invention, a cold water saponification method is provided which comprises the steps of: installing an empty tank; lowering high-shear stator into the tank—or—in case of in-line mixing, connecting mixer in-line; filling the tank with cold water; adding the base reagent to the water; starting the mixer at a pre determined RPM speed; adding the fatty acid to the reaction mix; and operating the mixer for a first pre determined period of time.

In a second aspect of the invention, the water is at a temperature of more than 0° C. and less than the fatty acid's pour point.

In a third aspect of the invention, the mixer is a high-shear mixer installed vertically inside the tank.

In a fourth aspect of the invention, the mixer is an inline high-shear mixer installed outside of the tank.

In a fifth aspect of the invention, the mixer comprises a stator with meshes.

In a sixth aspect of the invention, the mixer comprise a stator with substantially big holes.

In a seventh aspect of the invention, the mixer comprises a stator with slotted holes.

In an eighth aspect of the invention, the first pre determined period of time is less than 60 minutes.

In a ninth aspect of the invention, the first pre determined period of time is approximately 1 minute.

In a tenth aspect of the invention, the mixer is operated at a speed high enough to create a vortex capable of countering the flotation force of fatty acid particles on the surface of the solution.

In an eleventh aspect of the invention, the mixer operates at least at 6000 RPM.

In a twelfth aspect of the invention, the solution comprises water, fatty acids and a base dosed by weight.

In a fourteenth aspect of the invention, the method further comprises the step of letting the solution rest for a second pre-determined period of time.

In a fifteenth aspect of the invention, the second pre-determined period of time is less than 24 hours.

Finally, in a sixteenth aspect of the invention, the second pre-determined period of time is approximately 60 minutes.

The features of the present invention which are believed to be novel are set forth with particularity in the appended claims.

BRIEF DESCRIPTION OF THE DRAWINGS

The above and other objects, features and advantages of the invention will become more readily apparent from the following description, reference being made to the accompanying drawings in which.

DETAILED DESCRIPTION OF THE PREFERRED EMBODIMENT

A novel cold water fatty acid saponification method will be described hereinafter. Although the invention is described in terms of specific illustrative embodiment(s), it is to be understood that the embodiment(s) described herein are by way of example only and that the scope of the invention is not intended to be limited thereby.

Figure 1:
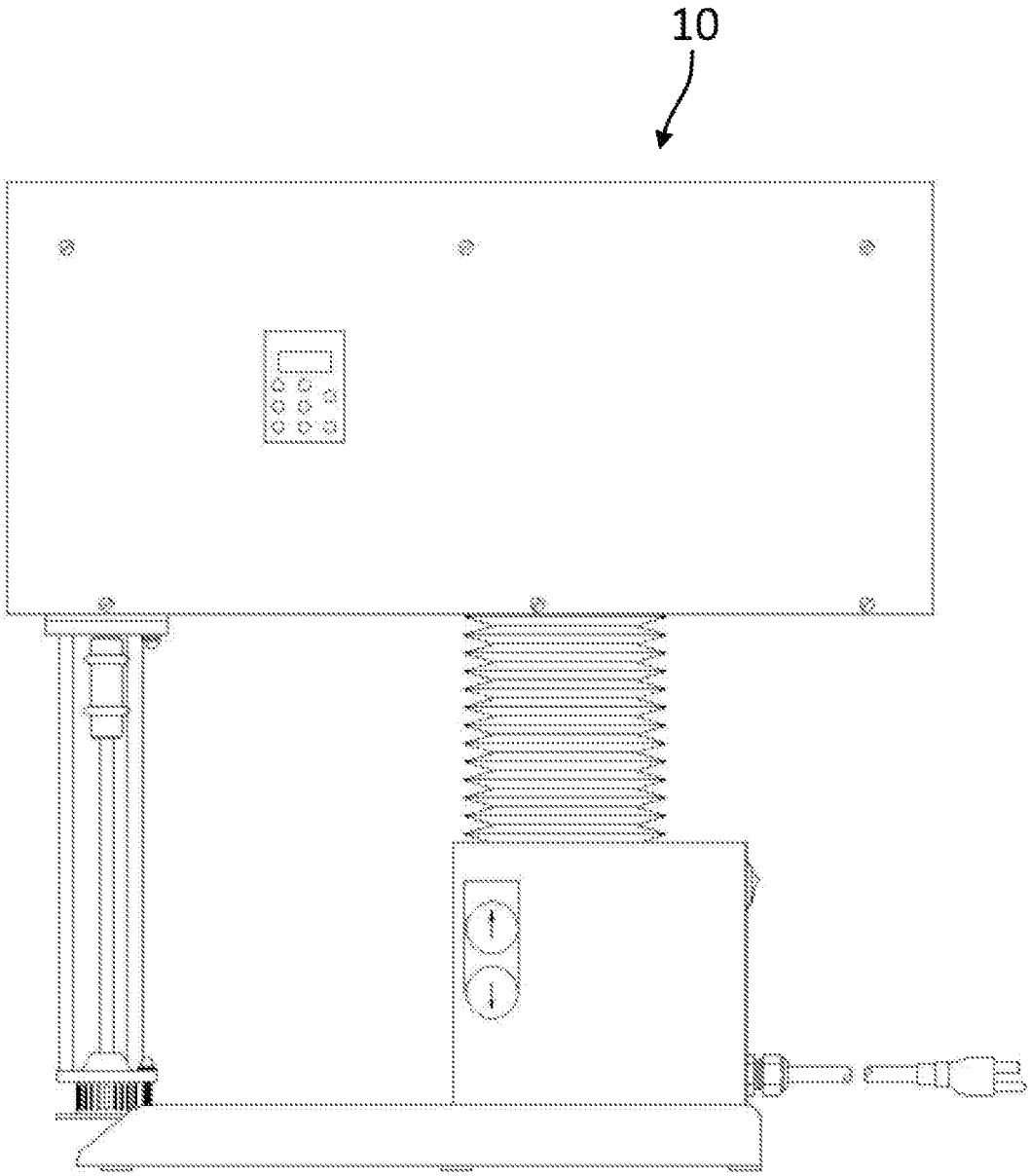
FIG. 1 is showing an embodiment of a high-shear mixer known in the art.

To overcome the issues of the use of cold water in the saponification of fatty acids, the method may use systems already known in the art. One system that may be used is a high-shear mixer which is known to be used and effective in dissolving solid particles in humid environments. FIG. 1 shows an embodiment of a high-shear mixer 10, which is generally used in industrial applications. High-shear mixers to be used are not limited by their size, configuration or number of functions.

Figure 2:
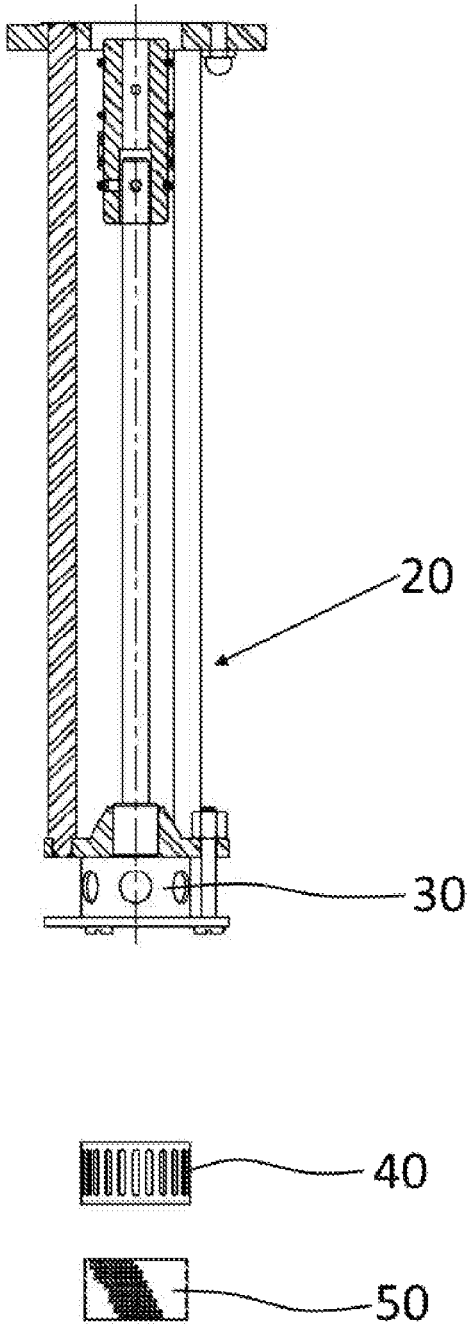
FIG. 2 is showing an embodiment of an attachment for a high-shear mixer known in the art.

Now shown in FIG. 2, is a view of three possible embodiments of a high-shear mixer stator 20. In a first embodiment, the end attachment 30 may comprise substantially big and round holes along the surface of the stator. In a second embodiment, the end attachment 40 may comprise slot holes along the surface of the stator. In a third embodiment, the end attachment 50 may be a stator comprising a fine screen, or mesh. Obviously, the type of stator used depends upon the initial size of the particles to be disintegrated and the desired final size of the disintegrated particles. In this type of application, the disintegration of fatty acid particles, a mesh stator 50 is generally the preferred embodiment as it generally provides the smallest disintegrated particles.

Once particles have been processed by the functioning stator, the cumulative contact area of all the particles of the solution is greater than what it was before the disintegration process. Thus, fatty acid particles may be better dispersed in the solution and consequently react more readily with the chosen solution base (NaOH or others). Using a high-shear mixer 10 may allow a better saponification process in cold water which may translate into considerable cost savings by eliminating the need to heat water.

In a first and preferred embodiment, the high-shear mixer 10 may be placed inside the reaction tank housing the solution in a vertical manner.

In a second embodiment, an inline high-shear mixer 10 that is connected to but placed outside of the tank may be used.

Through testing, it has been determined that an inline high-shear mixer 10 is not as efficient at breaking the fatty acid particles as a mixer 10 installed directly inside a tank. Fatty acids, due to having a tendency to float on the surface of water, require a vortex of a certain magnitude to be dragged from the surface to the center of a stator 20. It is consequently easier, simpler and faster to create such a vortex with the high-shear mixer 10 placed vertically inside a tank rather than outside.

Nonetheless, both embodiment may be used depending on the budget, configuration and needs of a saponification project.

Following small and large scale experiments, it has been proven that using high-shear mixers 10 in cold water saponification of fatty acids is efficient. Obviously, there are many aspects to consider when saponifying a solution which will affect the mixing time.

The mixing time may vary given multiple factors such as the quantity of liquid to fatty acid to mix, the temperature of the solution, the type of mixer end attachment (30, 40, 50) used and the rotational speed of the stator 20. In order to effectively saponify a solution comprising fatty acids, the mixing time of a preferred embodiment may be of approximately 1 minute. This period of time generally allows the fatty acid particles to be properly dispersed in the solution while avoiding a significant intrusion of air bubbles in the mix. Tests have been done for this duration at 1° C., 2° C. and 4° C. and have all shown similar satisfactory results. For generally longer periods of saponification, the intrusion of air bubbles may start significantly affecting the density of the solution.

The method may require the application of the final solution in the mix by weight instead of volume to allow more precise dosage.

In yet another embodiment, the method may comprise a rest period after the reaction in order to allow air bubbles and generated foam to dissipate from the solution.

Furthermore, another preferred embodiment has the stator 20 rotating at approximately 6000 RPM (rotations per minute). This rotational speed has proven to be effective in creating a vortex powerful enough to counter the flotation force of the fatty acid particles and bring them into the center of the stator 20. The stator's rotational speed is not limited to this embodiment as it may further be lower or higher.

While illustrative and presently preferred embodiment(s) of the invention have been described in detail hereinabove, it is to be understood that the inventive concepts may be otherwise variously embodied and employed and that the appended claims are intended to be construed to include such variations except insofar as limited by the prior art.

The invention claimed is:

1. A cold water saponification method, the method comprising the steps of:

a. installing a tank;

b. lowering a high-shear mixer stator with a rotating end attachment into the tank or connecting the high-shear mixer stator with the rotating end attachment in-line with the tank;

c. filling the tank with cold water;

d. adding a base reagent in the tank;

e. starting the high-shear mixer stator at a pre determined RPM speed;

f. adding a fatty acid in the tank thereby forming a mix, wherein the mix comprises the cold water, the base reagent and the fatty acid;

g. operating the high-shear mixer stator for a first pre determined period of time to fully saponify the mix into a solution, the first pre-determined period of time being less than an hour, wherein the pre-determined RPM speed is high enough to create a vertical vortex countering a flotation force of particles of the fatty acid on the surface of the mix.

2. The cold water saponification method of claim 1, wherein the cold water is at a temperature of more than 0° C. and less than the pour point of the fatty acid.

3. The cold water saponification method of claim 1, wherein the high-shear mixer stator is installed vertically inside the tank.

4. The cold water saponification method of claim 1, wherein the high-shear mixer stator in-line with the tank is installed outside of the tank.

5. The cold water saponification method of claim 3, wherein the end attachment comprises meshes.

6. The cold water saponification method of claim 3, wherein the end attachment comprises holes.

7. The cold water saponification method of claim 3, wherein the end attachment comprises slotted holes.

8. The cold water saponification method of claim 1, wherein the first pre-determined period of time is approximately 1 minute.

9. The cold water saponification method of claim 1, wherein the mixer operates at least at 6000 RPM.

10. The cold water saponification method of claim 1, wherein the cold water, the fatty acids and the base are dosed by weight.

11. The cold water saponification method of claim 1, the method further comprising letting the solution rest for a second pre-determined period of time, wherein the pre-determined RPM speed is low enough so that the second pre-determined period of time is less than 24 hours.

12. The cold water saponification method of claim 11, wherein the second pre-determined period of time is 60 minutes.

13. The cold water saponification method of claim 1, the mix comprising between 2 to 3% of fatty acid.

14. The cold water saponification method of claim 1, the mix comprising between 97 to 98% of cold water.

* * * * *